US007491950B2

(12) United States Patent
Breyer et al.

(10) Patent No.: US 7,491,950 B2
(45) Date of Patent: Feb. 17, 2009

(54) METHOD FOR RETROFITTING CONCRETE STRUCTURES

(75) Inventors: Kenneth Joe Breyer, Colton, CA (US); Bradley Steven Johnson, Cherry Valley, CA (US); George Edward Johnston, Loma Linda, CA (US); Martin Johnson, San Clemente, CA (US); Elwood Smietana, Lake Forest, CA (US); Ronald Hamburger, Belmont, CA (US); Michael J. Rojansky, Alamo, CA (US); John Shipp, Santa Ana, CA (US)

(73) Assignee: Loma Linda University Medical Center, Loma Linda, CA (US)

( * ) Notice: Subject to any disclaimer, the term of this patent is extended or adjusted under 35 U.S.C. 154(b) by 230 days.

(21) Appl. No.: 11/653,127

(22) Filed: Jan. 12, 2007

(65) Prior Publication Data

US 2008/0048130 A1 Feb. 28, 2008

Related U.S. Application Data

(63) Continuation of application No. 10/307,247, filed on Nov. 27, 2002, now Pat. No. 7,180,080, which is a continuation of application No. 10/100,223, filed on Mar. 15, 2002, now abandoned.

(60) Provisional application No. 60/358,132, filed on Feb. 20, 2002.

(51) Int. Cl.
*G21G 5/00* (2006.01)

(52) U.S. Cl. ..... 250/492.1; 52/167.1

(58) Field of Classification Search ..... 52/514, 52/514.5, 742.1, 742.14, 742.15
See application file for complete search history.

(56) References Cited

U.S. PATENT DOCUMENTS

| | | | |
|---|---|---|---|
| 3,871,485 | A | 3/1975 | Kennan, Jr. |
| 4,227,582 | A | 10/1980 | Price |
| 4,568,814 | A | 2/1986 | Hamasaki et al. |
| 5,657,595 | A | 8/1997 | Fyfe et al. |
| 5,664,389 | A | 9/1997 | Williams |
| 5,782,043 | A | 7/1998 | Duncan et al. |

(Continued)

FOREIGN PATENT DOCUMENTS

| | | |
|---|---|---|
| EP | 03 71 1113 | 2/2003 |

(Continued)

OTHER PUBLICATIONS

Hiroshi Yoshizawa, Sivakumaran Wignarajah and Hideaki Saito, Transactions of the Japan Welding Society, vol. 20, No. 1, Apr. 1989, pp. 31-36.

(Continued)

*Primary Examiner*—David A. Vanore
(74) *Attorney, Agent, or Firm*—Knobbe, Martens, Olson & Bear LLP

(57) ABSTRACT

A method of seismic retrofitting a concrete structure includes removing material from a portion of the concrete structure by irradiating the portion with a laser beam having a laser energy density. The method further includes positioning a stabilization structure in proximity to the portion of the concrete structure. The method further includes attaching the stabilization structure to the portion of the concrete structure, whereby the stabilization structure provides structural support to the concrete structure.

16 Claims, 13 Drawing Sheets

U.S. PATENT DOCUMENTS

| | | | |
|---|---|---|---|
| 5,920,938 | A | 7/1999 | Elcock et al. |
| 6,056,827 | A | 5/2000 | Fukui et al. |
| 6,064,034 | A | 5/2000 | Rieck |
| 6,114,676 | A | 9/2000 | Jerby et al. |
| 6,299,386 | B1 | 10/2001 | Byrne et al. |

FOREIGN PATENT DOCUMENTS

| | | |
|---|---|---|
| JP | 59-47086 | 3/1984 |
| JP | 60-168716 | 2/1985 |
| JP | 61-41672 | 2/1986 |
| JP | 03081080 | 4/1991 |
| JP | 06-050006 | 1/1994 |
| JP | 10-008723 | 1/1998 |
| JP | 10-131516 | 5/1998 |
| JP | 10331434 | 12/1998 |
| JP | 11-019785 | 1/1999 |
| JP | 11270153 | 10/1999 |
| JP | 2000-226938 | 8/2000 |
| JP | 2000240298 | 9/2000 |
| JP | P3180029 | 4/2001 |
| JP | 2001-303773 | 10/2001 |
| WO | WO 00/37208 | 6/2000 |

OTHER PUBLICATIONS

PCT International Search Report dated Sep. 23, 2003 in 5 pages.

"Guide to Concrete Repair", U.S. Department of the Interior, Bureau of Reclamation Technical Services Center, Aug. 1996, Fig. 48, and pp. 8-18, Appendix A.

Office Action with English translation from Japanese Patent Application 2003-569567, dated Jun. 4, 2008, in 7 pages.

METHOD FOR RETROFITTING CONCRETE STRUCTURES

CLAIM OF PRIORITY

This application is a continuation of U.S. patent application Ser. No. 10/307,247, filed Nov. 27, 2002 now U.S. Pat. No 7,180,080, which is a continuation of U.S. patent application Ser. No. 10/100,223, filed Mar. 15, 2002 now abandoned, which claims priority under 35 U.S.C. § 119(e) to U.S. Provisional Application No. 60/358,132, filed Feb. 20, 2002, each of which is incorporated in its entirety by reference herein.

BACKGROUND OF THE INVENTION

1. Field of the Invention

The invention relates in general to the field of construction, and specifically to improved apparatus and methods for seismic retrofitting concrete structures.

2. Description of the Related Art

Retrofitting of existing concrete structures is often necessary to meet improved building safety codes. For example, in regions of the world susceptible to earthquakes, building codes are continually examined and modified by the appropriate regulatory agencies to require improved structural resilience to seismic activity by retrofitting the existing structure to provide additional stability and resilience to seismic vibrations.

Seismic retrofitting of an existing concrete structure is often a large undertaking with significant inconveniences to the occupants of the concrete structure. Some retrofitting procedures comprise strengthening the concrete structure by coupling additional concrete and/or steel (to provide ductility). Other retrofitting procedures comprise isolating the concrete structure from the ground by installing shock absorbing systems. Typically, such construction projects entail high levels of noise, dust, pollution, vibration, and general disruption to the normal operations of the concrete structure. These inconveniences are especially troublesome for structures such as hospitals, where the occupants are especially sensitive to any disruptions, and relocation for the duration of the construction project is generally not feasible.

Mechanical drilling of concrete is an especially disruptive component of the retrofitting of concrete structures. Typically, such mechanical drilling is accomplished by using diamond-tipped rotary drills or impact drills, which drill by brute physical contact with the concrete surface. These types of mechanical drills produce high levels of noise, significant vibrations which propagate to other parts of the structure, and substantial amounts of dust and debris which require special protective measures.

Lasers have been used in exotic construction projects, because of their ability to cut a wide variety of materials and their applicability to hazardous or extreme conditions. For example, in U.S. Pat. No. 4,227,582 ("the '582 patent") issued to Price and incorporated in its entirety by reference herein, Price discloses an apparatus and method for perforating a well casing and its surrounding formations from within the confined area of an oil or gas well. In the '582 patent, the laser drilling tool is used in conjunction with a high pressure injection of exothermic gases (e.g., oxygen) and fluxing agents (e.g., powdered iron or alkali halides) which react with the drilled material to speed up the drilling process. In addition, U.S. Pat. No. 4,568,814 ("the '814 patent") issued to Hamasaki et al., and incorporated in its entirety by reference herein, discloses an apparatus and method for cutting concrete in highly hazardous contexts, such as for the dismantling of a biological shield wall in a nuclear reactor. The '814 patent also discloses the use of an automated laser cutter in the conjunction with MgO-rich supplementary materials and a cleaning device to facilitate the removal of the viscous molten slag produced by the cutting process.

A study of the cutting ability of a carbon dioxide laser as a function of numerous parameters to cut concrete and reinforced concrete has been performed by Yoshizawa, et al. entitled "Study on Laser Cutting of Concrete" and published in the April 1989 "Transactions of the Japan Welding Society," Vol. 20, No. 1, p. 31 (hereafter referred to as "the Yoshizawa article"), which is incorporated in its entirety by reference herein. The Yoshizawa article provides data from laboratory experiments which monitored the depth of cuts generated by the laser as a function of laser power, assist gas pressure and direction, laser lens focal length, scanning speed of the laser spot across the concrete, and types and water content of the concrete. In addition, the Yoshizawa article concluded that laser energy densities greater than approximately $10^6$ W/cm$^2$ are necessary to cut concrete, and laser energy densities greater than approximately $10^7$ W/cm$^2$ are necessary to cut steel-reinforced concrete.

SUMMARY OF THE INVENTION

In one embodiment of the present method, there is disclosed a method of seismic retrofitting a concrete structure. The method comprises removing material from a portion of the concrete structure by irradiating the portion with a laser beam having a laser energy density. The method further comprises positioning a stabilization structure in proximity to the portion of the concrete structure. The method further comprises attaching the stabilization structure to the portion of the concrete structure, whereby the stabilization structure provides structural support to the concrete structure.

In another embodiment of the present method, there is disclosed a method of seismic retrofitting a concrete structure occupied by equipment and people. The equipment and people have a noise tolerance level, a vibration tolerance level, and a particulate tolerance level. The method comprises removing material from a portion of the concrete structure by irradiating the portion with a laser beam. Removing the material generates noise at a noise level less than the noise tolerance level, vibrations at a vibration level less than the vibration tolerance level, and particulates at a particulate level less than the particulate tolerance level. The method further comprises positioning a stabilization structure in proximity to the portion of the concrete structure. The method further comprises attaching the stabilization structure to the portion of the concrete structure, whereby the stabilization structure provides structural support to the concrete structure.

In yet another embodiment of the present method, there is disclosed a method of seismic retrofitting a concrete structure. The method comprises removing material from a portion of the concrete structure by irradiating the portion with a laser beam. The method further comprises providing structural support to the concrete structure.

For purposes of summarizing the invention and the advantages achieved over the prior art, certain objects and advantages of the invention have been described herein above. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the present invention herein disclosed. These and other embodiments of the present invention will become readily apparent to those skilled in the art from the following detailed description of the preferred embodiments having reference to the attached figures, the invention not being limited to any particular embodiment disclosed.

DETAILED DESCRIPTION OF THE PREFERRED EMBODIMENT

Figure 1:
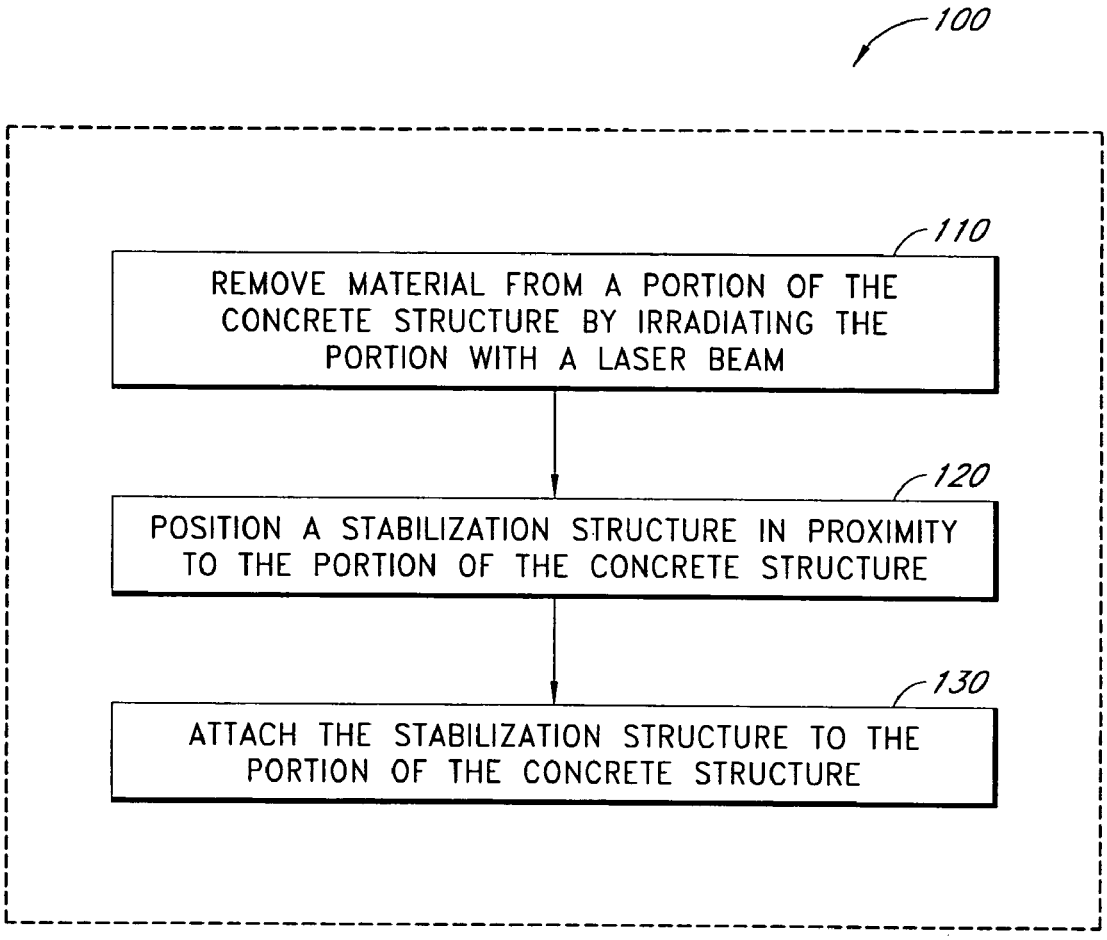
FIG. 1 is a flowchart of one embodiment of a method of seismic retrofitting a concrete structure.

FIG. 1 is a flowchart of one embodiment of a method 100 of seismic retrofitting a concrete structure 10. The method 100 comprises an operational block 110 comprising removing material from a portion 20 of the concrete structure 10 by irradiating the portion 20 with a laser beam 30 having a laser energy density. The method 100 further comprises an operation block 120 comprising positioning a stabilization structure 40 in proximity to the portion 20 of the concrete structure 10. The method 100 further comprises an operational block 130 comprising attaching the stabilization structure 40 to the portion 20 of the concrete structure 10. The stabilization structure 40 provides structural support to the concrete structure 10.

By using a laser beam 30 to remove material from the portion 20 of the concrete structure 10, seismic retrofitting of the concrete structure 10 can be performed with significantly less noise, vibrations, and particulates than are produced using conventional drilling or cutting techniques. Typically, concrete structures 10, such as buildings, are occupied by equipment and people which have a noise tolerance level, a vibration tolerance level, and a particulate tolerance level. For example, in certain embodiments, the concrete structure 10 comprises a healthcare facility, such as a hospital, which is occupied by healthcare equipment, personnel, and patients which are particularly sensitive to disruptions and excessive noise, vibration, and particulates. The levels of noise, vibration, and particulates generated by the removal of material from the portion 20 of the concrete structure 10 by irradiating the portion 20 with the laser beam 30 can be less than the corresponding tolerance levels, thereby permitting the seismic retrofitting to be performed without disturbing the operations of the healthcare facility or its patients.

In certain embodiments, the position, motion, scanning speed, and laser energy density of the laser beam 30 are all preferably controlled by a control system. The control system can be controlled by a programmable microchip, or can be operated manually to perform the desired removal of material as described herein. Persons skilled in the art are able to configure a control system in accordance with embodiments of the present invention.

The laser beam 30 is generated by a laser system, which in certain embodiments comprises a hydrofluorine chemically driven laser, a carbon dioxide laser, a solid state laser such as neodymium glass, or other types of advanced lasers. In certain embodiments, the various operating parameters of the laser system, including but not limited to pulse length, frequency, laser energy density, and area and diameter of the laser beam 30, are controlled by the control system to provide optimal cutting and boring for the seismic retrofitting procedures being performed. In addition, the laser system of certain embodiments is adapted to permit the laser beam 30 to be positioned and scanned across the surface of the portion 20 of the concrete structure 10 to be irradiated. The laser system of certain embodiments is configured to avoid excessive heating of the concrete, thereby avoiding substantial damage to the structural integrity of the concrete structure 10. For example, the laser energy density and laser cutting speed are preferably optimized to provide a clean surface cut with a minimum of heat transferred to the concrete. Other embodiments include the use of water or other cooling fluids to limit heat damage to the concrete structure 10.

The laser system of certain embodiments can also comprise an apparatus to assist the removal of slag from the cutting region. In certain embodiments, slag removal is assisted by a source of gases and a nozzle to generate a gas stream which accelerates the rate of laser beam penetration by blowing away the irradiated slag from the cutting region. In other embodiments, the gases comprise exothermically reactive gases which interact with a fluxing agent to assist the removal of material. In still other embodiments, the laser system comprises a source of MgO-rich supplementary material which is mixed with the molten slag, thereby making the slag more easily removable. Such embodiments can also comprise a cleaning device, such as a wire brush, scraping tool, or vacuum system, to remove the slag from the irradiated region. Timely removal of hot slag will further help control the heat transferred to the concrete, thus preferably reducing the heat damage to the concrete structure 10. Examples of laser systems compatible with embodiments of the present invention are described by the '582 patent of Price and the '814 patent of Hamasaki, et al., which are incorporated in their entirety by reference herein.

Figure 2A:
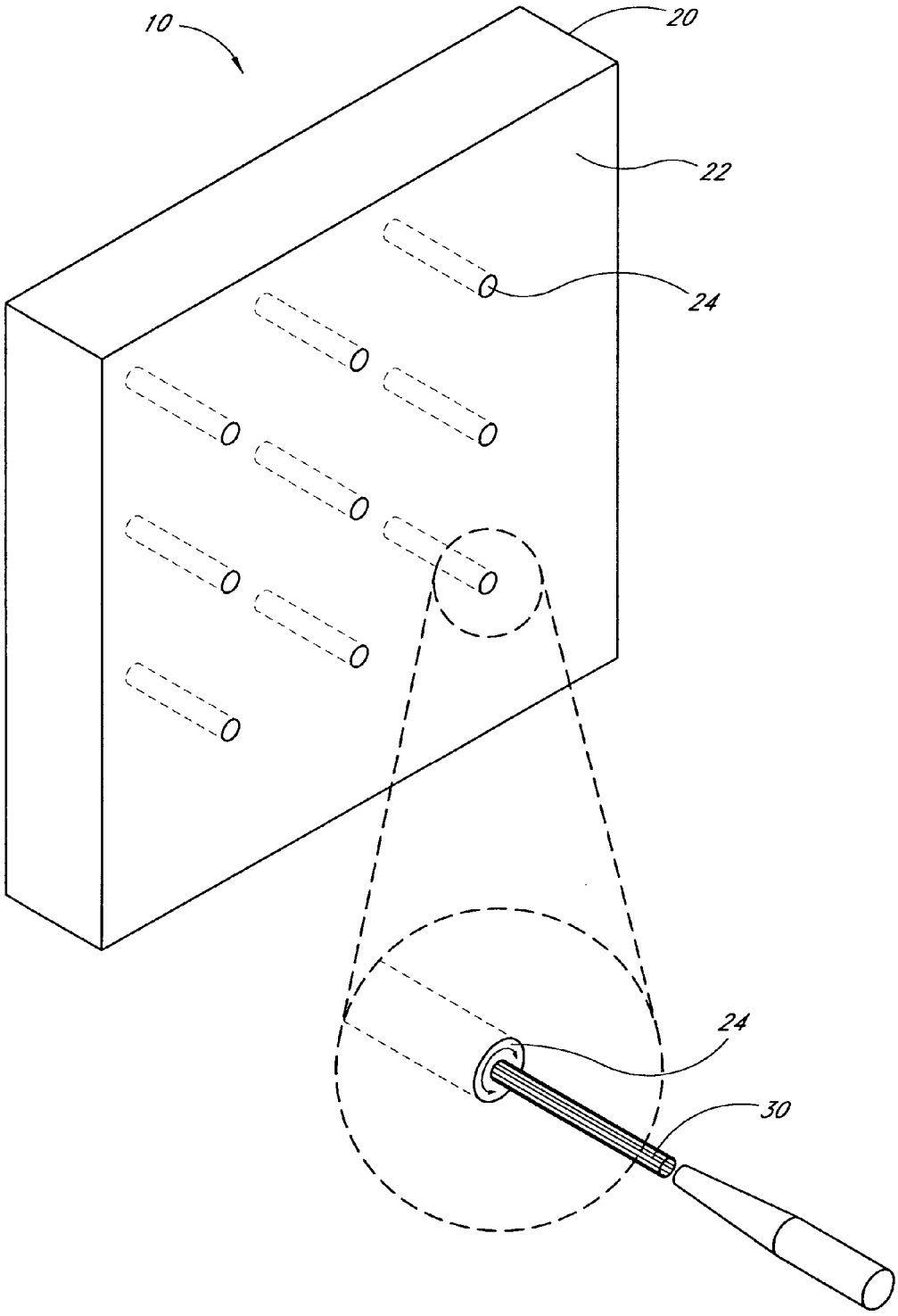
FIGS. 2A, 2B, and 2C schematically illustrate one embodiment of seismic retrofitting a portion of a concrete structure comprising a wall with holes bored by irradiation by a laser beam.
Figure 2B:
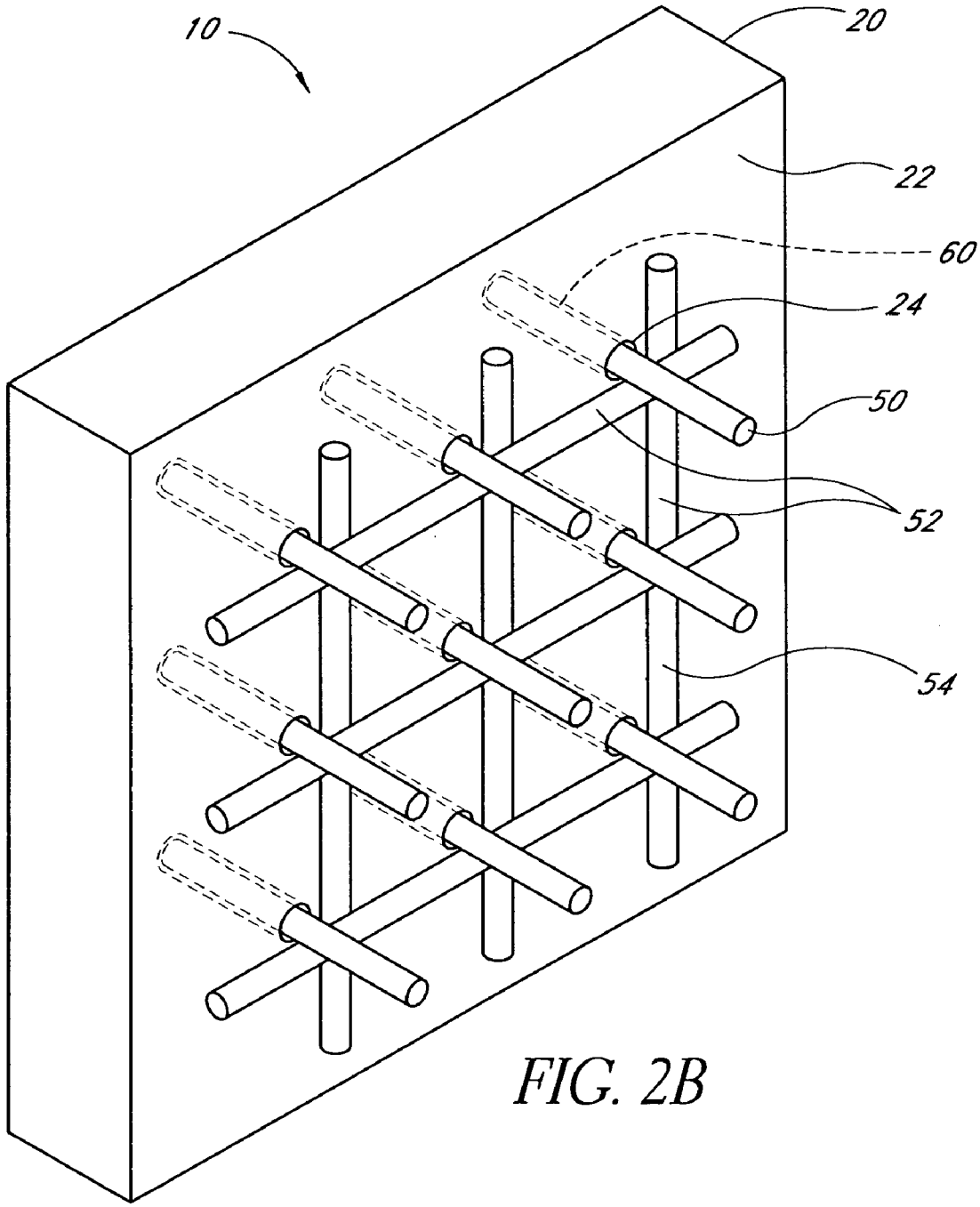
Figure 2C:
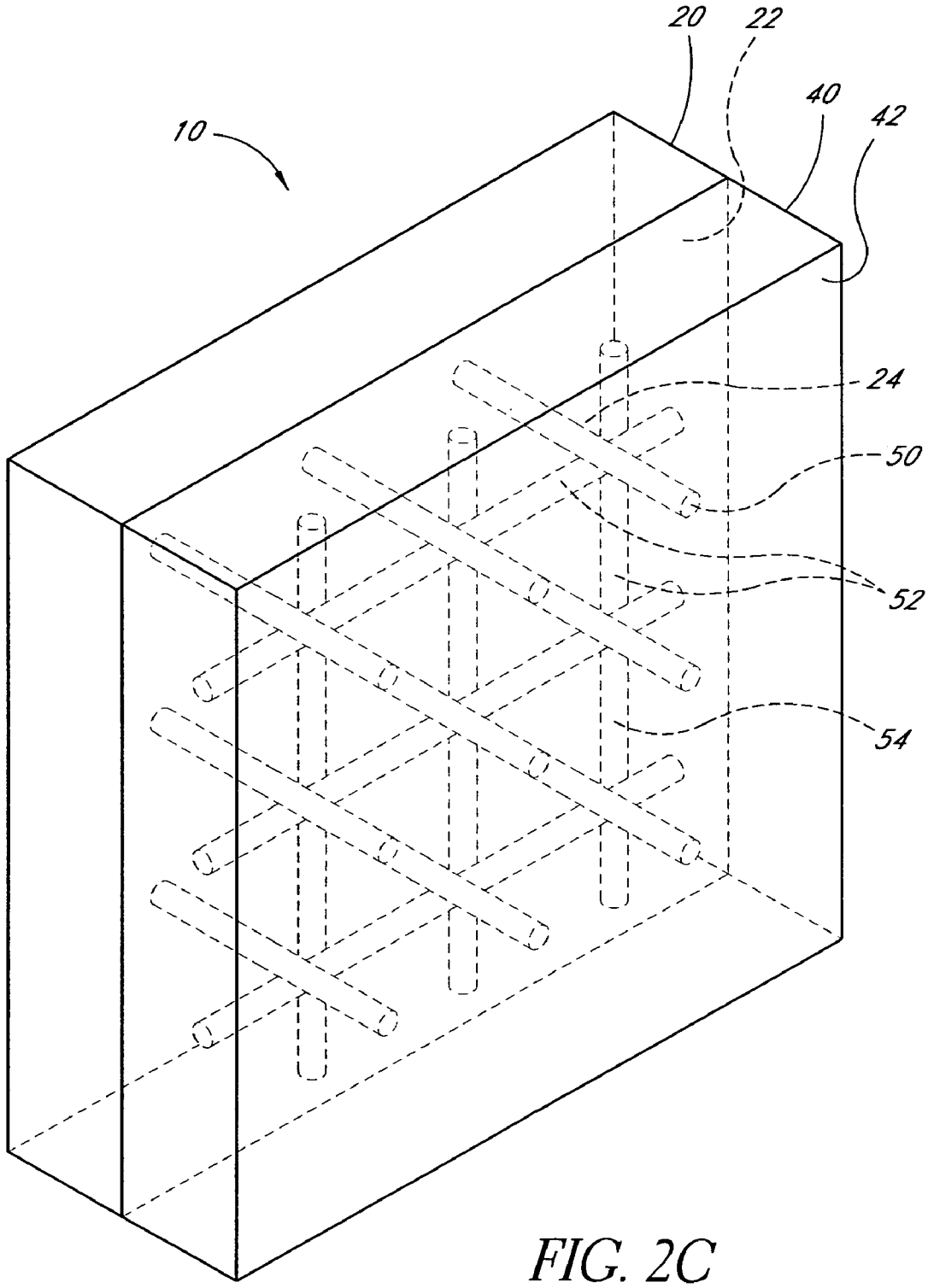

FIGS. 2A, 2B, and 2C schematically illustrate one embodiment of seismic retrofitting a portion 20 of a concrete structure 10. In the embodiment schematically illustrated in FIG. 2A, the portion 20 comprises a wall 22. In one embodiment, material is removed from the wall 22 by irradiating the wall 22 with a laser beam 30 having a laser energy density, thereby boring a hole 24 into the wall 22. The hole 24 of certain embodiments can extend through the full width of the wall 22, while in other embodiments the hole 24 extends only partially through the width of the wall 22, as schematically illustrated in FIG. 2A.

In certain embodiments, the laser beam 30 is configured such that a substantially cylindrical hole 24 is formed without substantial movement of the laser beam 30 across the surface of the wall 22. In other embodiments, boring the hole 24 comprises moving the laser beam 30 in a circular motion along a surface of the wall 22 such that a substantially cylindrical hole is formed. As described in the Yoshizawa article, the depth of a laser cut in concrete can be controlled, in part, by the speed at which the laser beam 30 is scanned across the surface of the concrete. The hole 24 can then be bored by making multiple passes of the laser beam 30 over an area of the concrete until a desired depth and width of material is removed. This procedure can also provide additional control of the heat transferred into the concrete to reduce thermal damage. In still other embodiments, the hole 24 has a generally conical shape or even an arbitrary shape. Persons skilled in the art are able to configure a laser to generate the laser beam 30 with an appropriate laser energy density to bore the hole 24 in accordance with embodiments of the present invention.

As schematically illustrated in FIG. 2B, in certain embodiments, positioning a stabilization structure 40 in proximity to the wall 22 comprises positioning a rebar 50 in the hole 24 in the wall 22 and affixing the rebar 50 in the hole 24. Typically, the rebar 50 comprises steel or iron, and provides additional coupling between the portion 20 of the concrete structure 10 and the stabilization structure 40. The rebar 50 also provides additional structural strength to the stabilization structure 40. In certain embodiments, the rebar 50 is placed in the hole 24, epoxy 60 is applied between the rebar 50 and the hole 24, and the epoxy 60 is given time to set, thereby affixing the rebar 50 to the wall 22. Persons skilled in the art are able to select an appropriate epoxy 60 in accordance with embodiments of the present invention.

In typical embodiments, more than one hole 24 is bored into the wall 22, each hole 24 having a rebar 50 affixed therein. In certain embodiments, the rebars 50 affixed to the wall 22 are coupled together by other rebars 52, thereby forming a rebar lattice structure 54, as schematically illustrated in FIG. 2B. Persons skilled in the art are able to configure the rebars 50, 52 in accordance with embodiments of the present invention.

In certain embodiments, attaching the stabilization structure 40 to the wall 22 further comprises forming a stabilization wall 42 by pouring concrete 70 into a temporary mold built around the rebars 50. Upon setting, the poured concrete 70 forms the stabilization wall 42 which is contiguously coupled to the wall 22, and which comprises the rebars 50, 52, as schematically illustrated in FIG. 2C. In such an embodiment, the stabilization wall 42 provides structural support to the concrete structure 10. Persons skilled in the art are able to form a stabilization wall 42 in accordance with embodiments of the present invention.

Figure 3A:
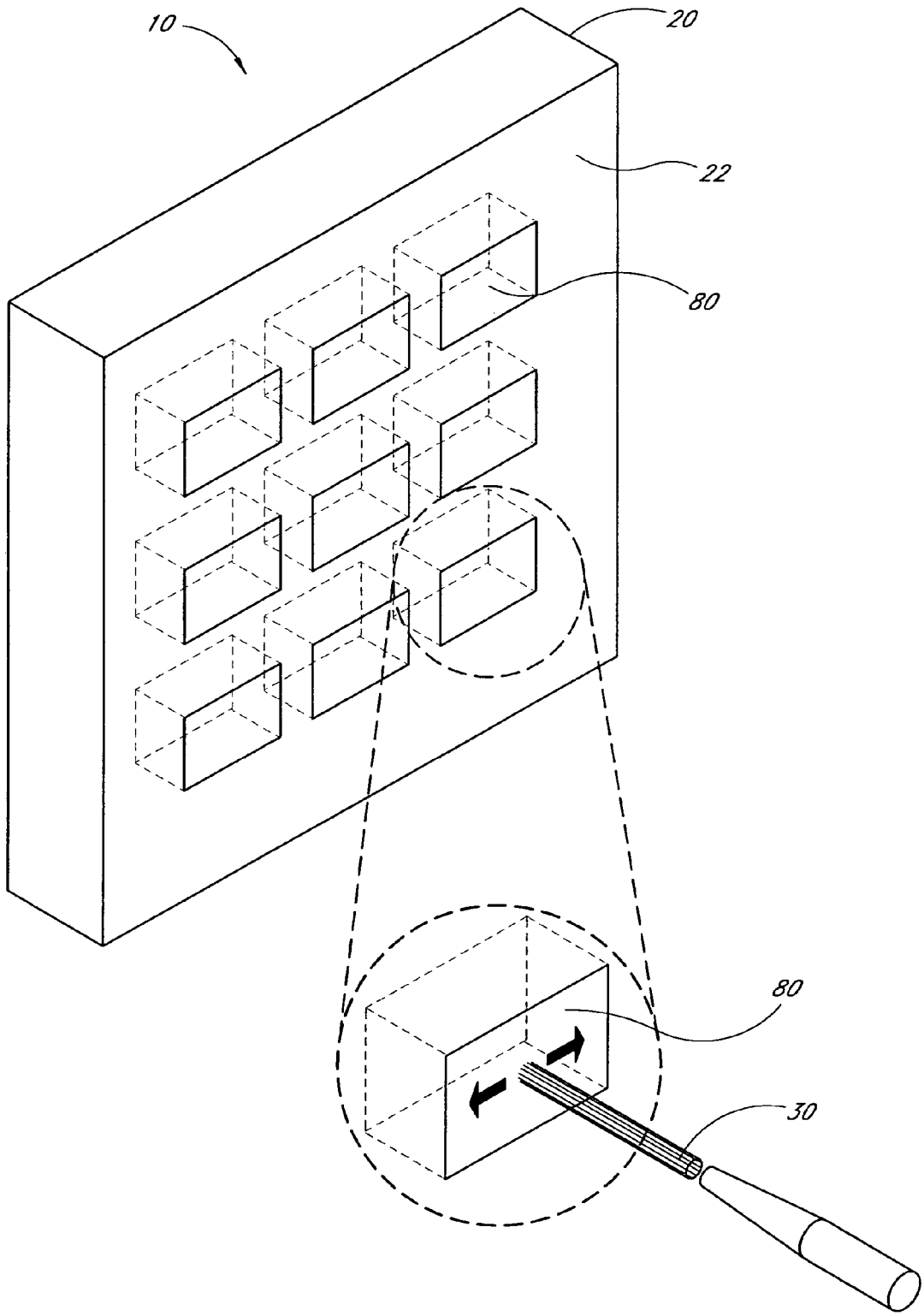
FIGS. 3A and 3B schematically illustrate one embodiment of seismic retrofitting a portion of a concrete structure comprising a wall with keys cut by irradiation by a laser beam.

As schematically illustrated in FIG. 3A, in other embodiments of the present invention, the portion 20 of the concrete structure 10 comprises a wall 22 and removing material from the wall 22 comprises cutting a key 80 into the wall 22. The key 80 is a cutout from the surface of the wall 22, as schematically illustrated in FIG. 3A. In certain embodiments, cutting the key 80 comprises moving the laser beam 30 in multiple cutting passes along a surface of the wall 22 such that a generally rectangular key 80 is formed. In other embodiments, the key 80 has a circular shape or even an arbitrary shape. Typically, more than one key 80 is cut into the wall 22 to provide additional structural strength, as described in more detail below. Persons skilled in the art are able to configure keys 80 having dimensions and shapes compatible with the present invention.

Figure 3B:
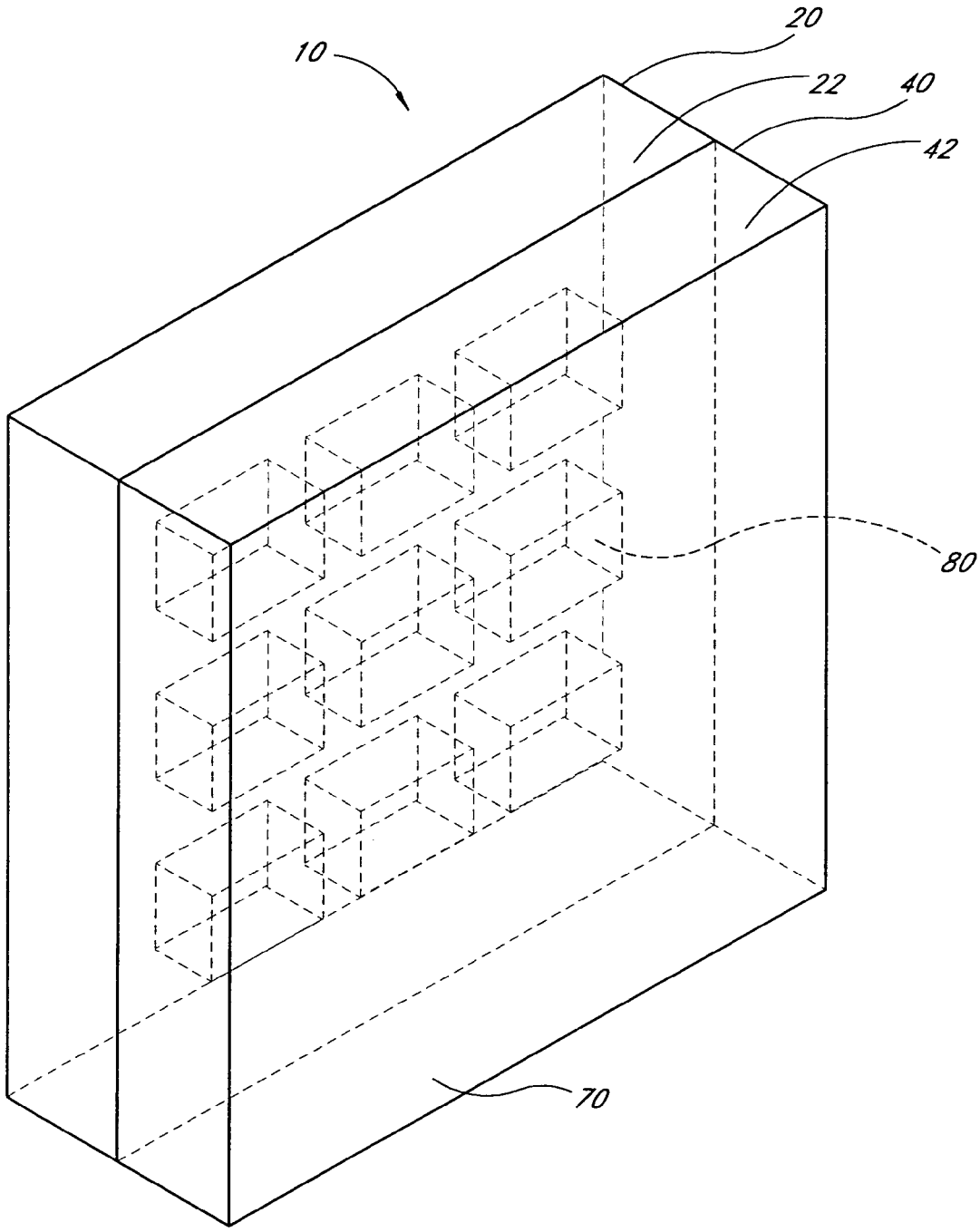

In certain embodiments, positioning a stabilization structure 40 in proximity to the wall 22 and attaching the stabilization structure 40 to the wall 22 comprises forming a stabilization wall 42 by pouring concrete 70 into a temporary mold built around a surface of the wall 22 with the keys 80, thereby filling the keys 80 with the poured concrete 70. Upon setting, the poured concrete 70 forms the stabilization wall 42 which is contiguously coupled to the wall 22 by an interlocking structure at the surface between the wall 22 of the concrete structure 10 and the stabilization wall 42, as schematically illustrated in FIG. 3B. In such an embodiment, the stabilization wall 42 provides structural support to the concrete structure 10, whereby the keys 80 resist shear stresses between the wall 22 and the stabilization wall 42. In certain embodiments, the keys 80 described herein are formed in conjunction with the holes 24 and rebars 50, 52 described above to form a stabilization wall 42 with additional structural stability. Persons skilled in the art are able to form a stabilization wall 42 in accordance with embodiments of the present invention.

In certain embodiments, the portion 20 of the concrete structure 10 to be seismically retrofitted comprises rebars 56 which provide additional structural strength to the portion 20. For stronger structural support for the concrete structure 10, the stabilization structure 40 of certain embodiments is coupled to the rebars 56 of the portion 20. In such embodiments where the portion 20 of the concrete structure 10 comprises a rebar 56 embedded in the concrete structure 10, removing material comprises removing concrete to expose a portion of the rebar 56.

Figure 4:
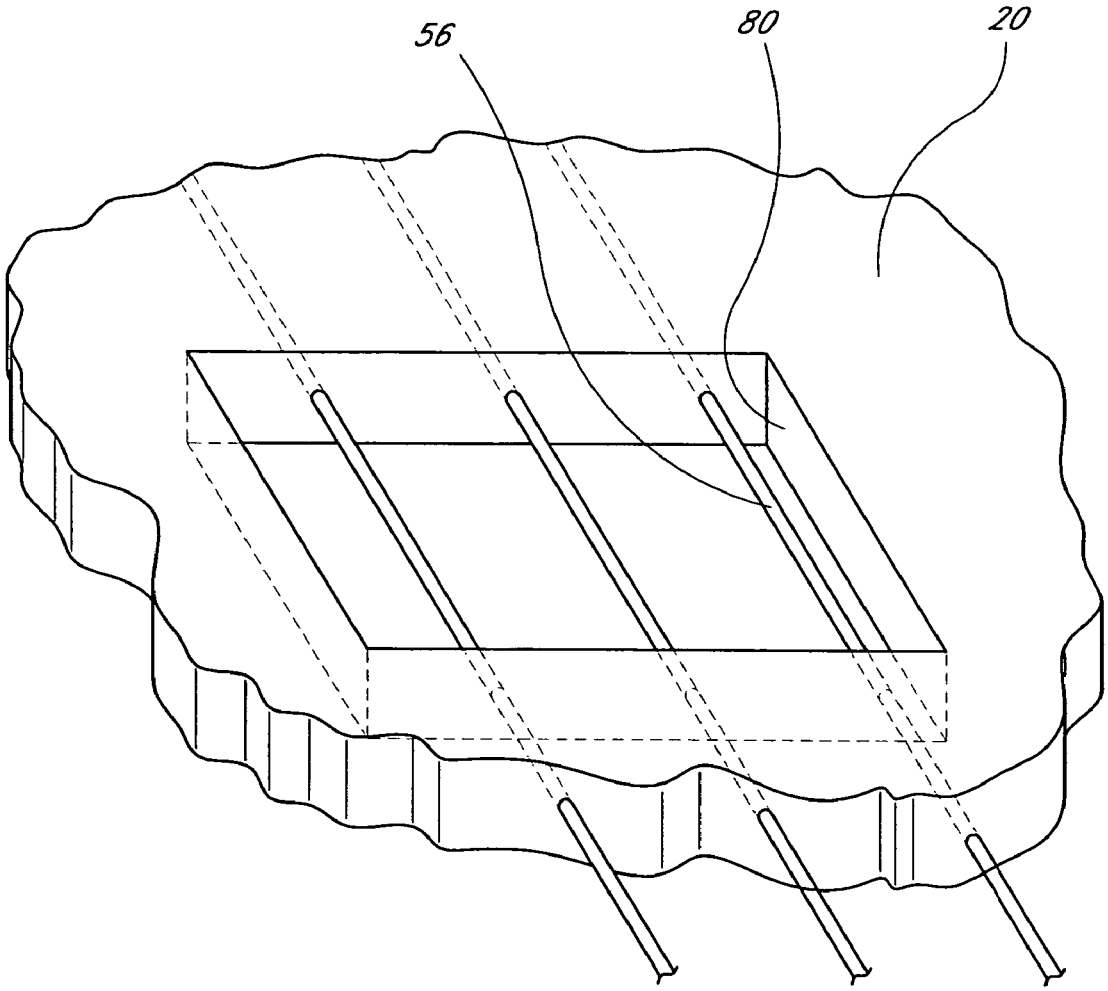
FIG. 4 schematically illustrates a key cut by the laser beam in proximity to the rebars of the portion of the concrete structure.

In embodiments in which keys 80 are cut into the portion 20, the keys 80 can be cut by the laser beam 30 in proximity to the rebars 56 of the portion 20 and having dimensions such that the rebars 56 are exposed, as schematically illustrated in FIG. 4. The poured concrete 70 which comprises the stabilization structure 40 can then couple to the rebars 56, thereby providing additional structural strength. In certain embodiments, the rebars 56 are only partially exposed by the laser beam 30, while in other embodiments, portions of the rebars 56 have the surrounding concrete completely removed by the laser beam 30, such that the poured concrete 70 of the stabilization structure 40 surrounds the portions of the rebars 56. In other embodiments, the exposed rebars 56 can be coupled to additional rebars 50, 52 of the stabilization structure 40, thereby providing a more intimate coupling between the portion 20 of the concrete structure 10 and the stabilization structure 40. Similarly, in embodiments in which holes 24 are bored by the laser beam 30 into the portion 20, the holes 24 can be positioned and have dimensions to advantageously expose portions of the rebars 56 in the portion 20 of the concrete structure 10.

Figure 5:
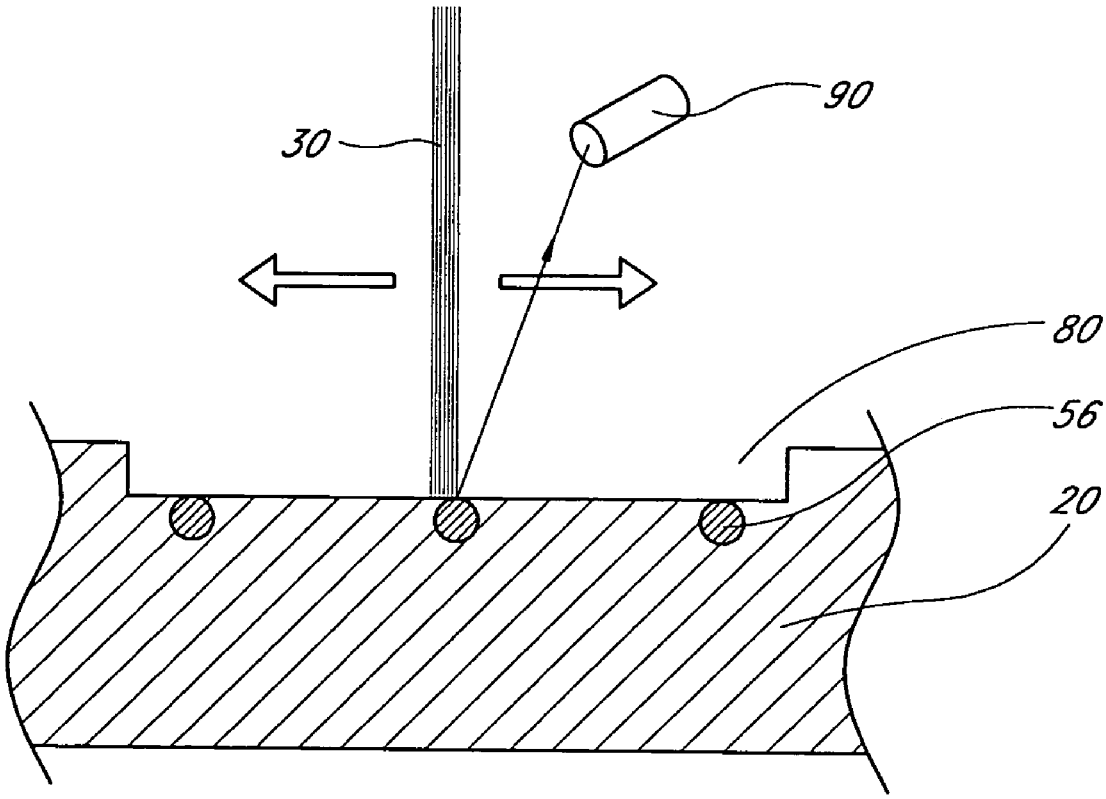
FIG. 5 schematically illustrates one embodiment of a configuration in which the laser beam cuts away a section of concrete in which a rebar is embedded.

In order to minimize damage to the rebar 56 in the portion 20 of the concrete structure 10 by the laser beam 30, in certain embodiments, removing material from the portion 20 of the concrete structure 10 further comprises detecting the rebar 56 and avoiding substantially irradiating the rebar 56, thereby avoiding substantially damaging the rebar 56. FIG. 5 schematically illustrates one embodiment of a configuration in which the laser beam 30 is cutting away a section of concrete in which a rebar 56 is embedded, the configuration comprising an electronic eye 90. The arrow indicates the scanning direction of the laser beam 30 across the concrete being cut. In certain embodiments, a relatively shallow depth of concrete is preferably cut away on each pass of the laser beam 30, with the passes being repeated until the rebar 56 is exposed and detected by the electronic eye 90.

In certain embodiments, the electronic eye 90 is disposed such that the electronic eye 90 detects the rebar 56 by detecting light reflected from the rebar 56 as material is being removed and responding to differences in the reflectance of the rebar 56 and the concrete. The reflected light can be generated by the laser beam 30, ambient light, or other light source. In other embodiments, the electronic eye 90 is responsive to photospectrometry differences or other differences in the interactions of the rebar 56 and the concrete to the incident light. In still other embodiments, the electronic eye 90 is responsive to other characteristics of the rebar 56 which differ from those of the surrounding concrete. Persons skilled in the art can configure the electronic eye 90 in accordance with embodiments of the present invention.

In certain embodiments, once light reflected from the rebar 56 is detected by the electronic eye 90, the laser beam 30 is advanced away from the rebar 56 to another section of concrete, thereby avoiding substantially irradiating the rebar 56. In alternative embodiments, the laser energy density of the laser beam 30 is reduced upon detecting light reflected from the rebar 56. As described in the Yoshizawa article incorporated by reference herein, the laser energy density of the laser beam 30 can be reduced to a level which can cut concrete but leaves rebar substantially undamaged. In this way, the concrete can be cut to an appropriate depth to ensure sufficient coupling between the concrete structure 10 and the stabilization structure 40, and damage to the rebar 56 within the concrete structure 10 is limited so as not to affect its structural integrity.

In still other embodiments, the position of the rebar 56 within the concrete structure 10 can be located using x-rays. By imaging the rebar 56 within the portion 20 of the concrete structure 10 from a plurality of directions, the depth of the rebar 56 within the portion 20 of the concrete structure 10 can be determined, as well as the location of the rebar 56 along the surface of the portion 20 of the concrete structure 10. Such determinations of the locations of the rebars 56 can be performed before the laser beam 30 is positioned to remove material, thereby allowing a user to determine a suitable location at which to bore holes 24, cut keys 80, or remove material. Persons skilled in the art are able to utilize x-rays to locate the rebar 56 in accordance with embodiments of the present invention.

Figure 6A:
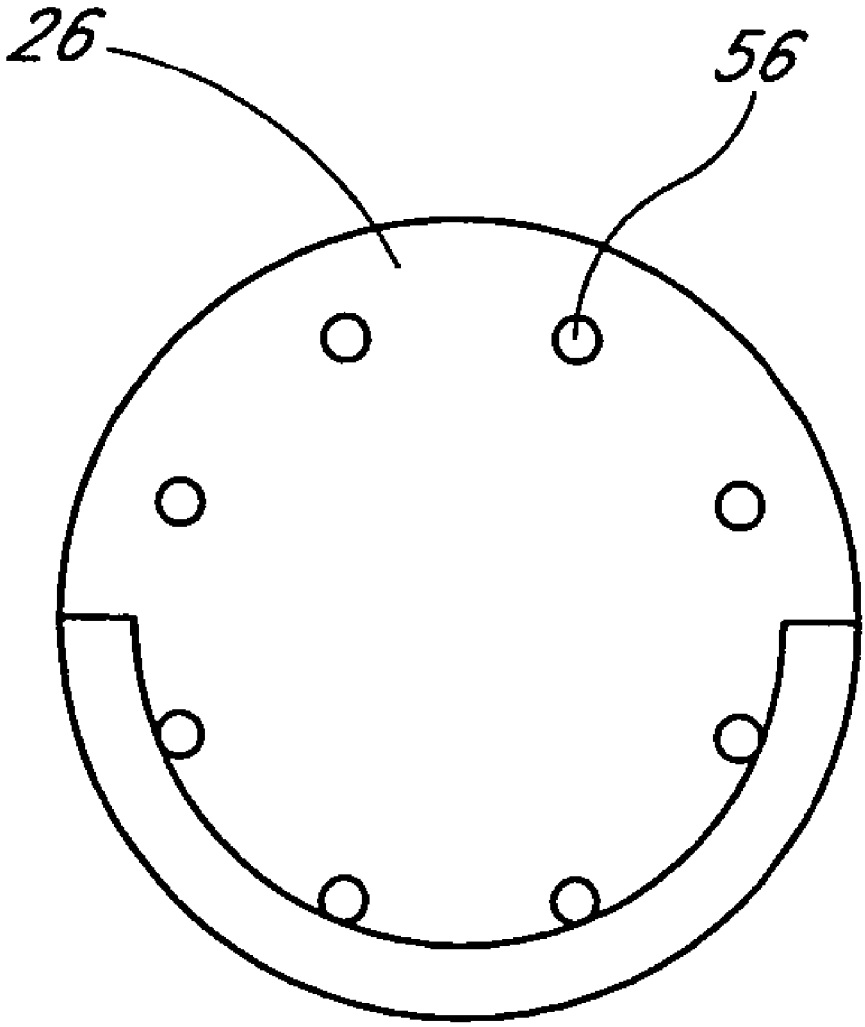
FIGS. 6A, 6B, and 6C schematically illustrate one embodiment of seismic retrofitting a portion of a concrete structure comprising a column with holes bored by irradiation by a laser beam.
Figure 6B:
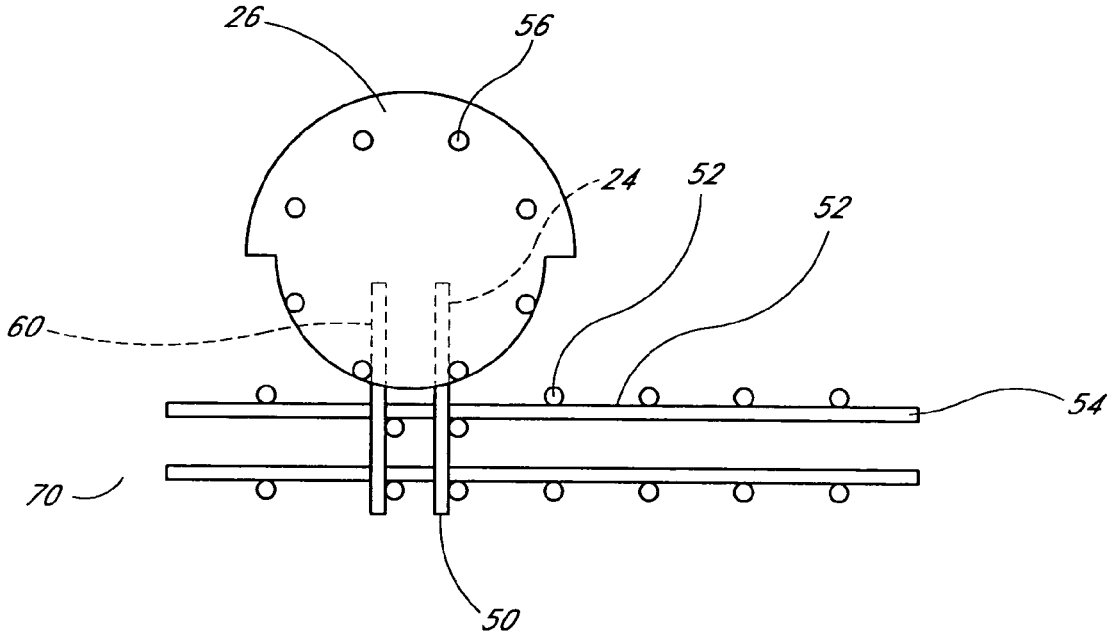
Figure 6C:
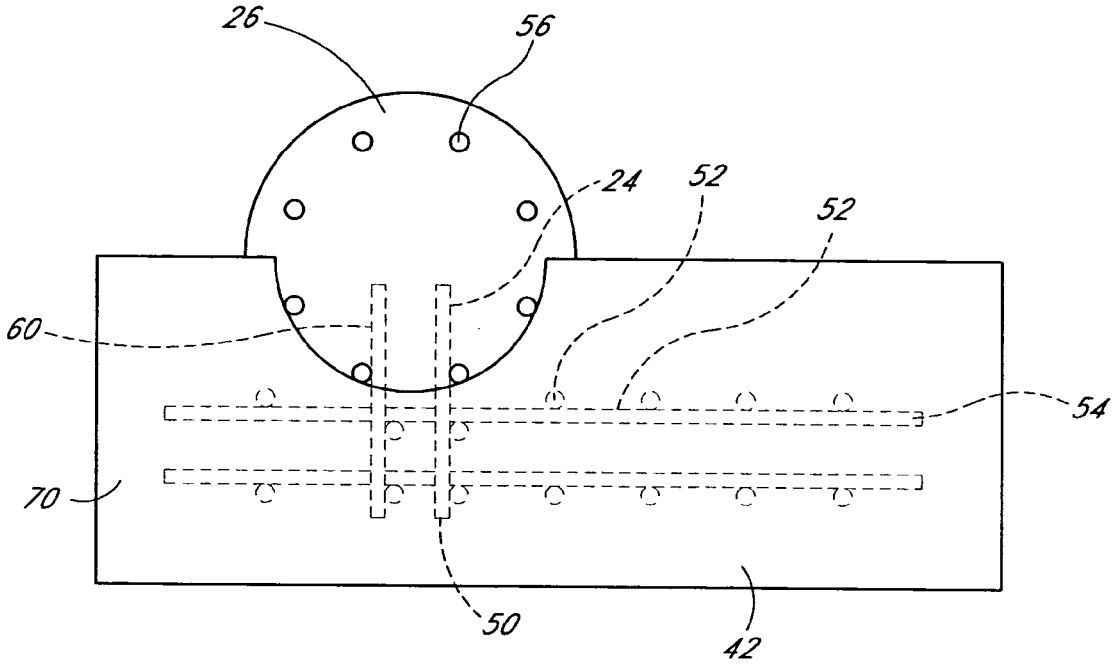

As schematically illustrated in FIGS. 6A, 6B, and 6C, in certain embodiments, the portion 20 of the concrete structure 10 comprises a column 26 and removing material from the portion 20 comprises boring a hole 24 into the column 26. These holes 24 are used in certain embodiments to couple a stabilization structure 40 comprising a stabilization wall 42 to the column 26. In embodiments in which the column 26 comprises rebars 56, the locations of the existing rebars 56 are identified so that the holes 24 for new rebars 50 can be located in proximity to the existing rebars 56 in the column 26. In certain embodiments, as schematically illustrated in FIG. 6A, the locations of the existing rebars 56 in the column 26 are identified by removing material from the outer surface of the column 26 by irradiating the column 26 with the laser beam 30, thereby exposing the rebars 56. Typically, the rebars 56 are approximately 1.5" below the surface of the column 26, thereby requiring approximately 1.5" of concrete to be removed by irradiation with the laser beam 30 in the region where the column 26 is to be coupled to the stabilization wall 42. Persons skilled in the art recognize that the actual depth may vary depending on the particular column 26 being seismically retrofitted. Additionally, the removal of the surface material from the column 26 can be used to roughen the surface, thereby providing a stronger coupling between the column 26 and the stabilization wall 42.

The holes 24 are bored by irradiating the column 26 with the laser beam 30 in proximity to the existing rebars 56 of the column 26, as schematically illustrated in FIG. 6B. In certain embodiments, boring a hole 24 into the column 26 comprises moving the laser beam 30 in a circular motion along a surface of the column 26 such that a substantially cylindrical hole 24 is formed, as described above in relation to boring a hole 24 in a wall 22.

As described above in relation to seismic retrofitting a wall 22, the column 26 of certain embodiments is coupled to a stabilization wall 42, whereby the stabilization wall 42 provides structural support to the column 26. In such embodiments, rebars 50 are affixed by epoxy 60 in the holes 24 bored by the laser beam 30. In typical embodiments, more than one hole 24 is bored into the column 26, and each hole 24 has a rebar 50 affixed therein. In certain embodiments, the rebars 50 affixed to the column 26 are coupled together by other rebars 52, thereby forming a rebar lattice structure 54, as schematically illustrated in FIG. 6B. Persons skilled in the art are able to configure the rebars 50, 52 in accordance with embodiments of the present invention.

In certain embodiments, coupling the stabilization structure 40 to the column 26 further comprises forming a stabilization wall 42 by pouring concrete 70 into a temporary mold built around the rebars 50. Upon setting, the poured concrete 70 forms the stabilization wall 42 which is contiguously coupled to the column 26, and which comprises the rebars 50, 52, as schematically illustrated in FIG. 6C. In such an embodiment, the stabilization wall 42 provides structural support to the column 26. Persons skilled in the art are able to form a stabilization wall 42 in accordance with embodiments of the present invention.

Alternatively, or in addition to boring holes 24 in the column 26, removing material from the column 26 in certain embodiments comprises cutting a key 80 into the column. In certain embodiments, cutting a key 80 into the column 26 comprises moving the laser beam 30 in multiple cutting passes along a surface of the column 26, as described above in relation to cutting a key 80 in a wall 22. Upon setting, the poured concrete 70 forms the stabilization wall 42 which is contiguously coupled to the column 26 by an interlocking structure at the surface between the column 26 and the stabilization wall 42. In such an embodiment, the stabilization wall 42 provides structural support to the column 26, whereby the keys 80 resist shear stresses between the column 26 and the stabilization wall 42. Persons skilled in the art can select an appropriate removal of material from the column 26 in accordance with embodiments of the present invention.

Figure 7:
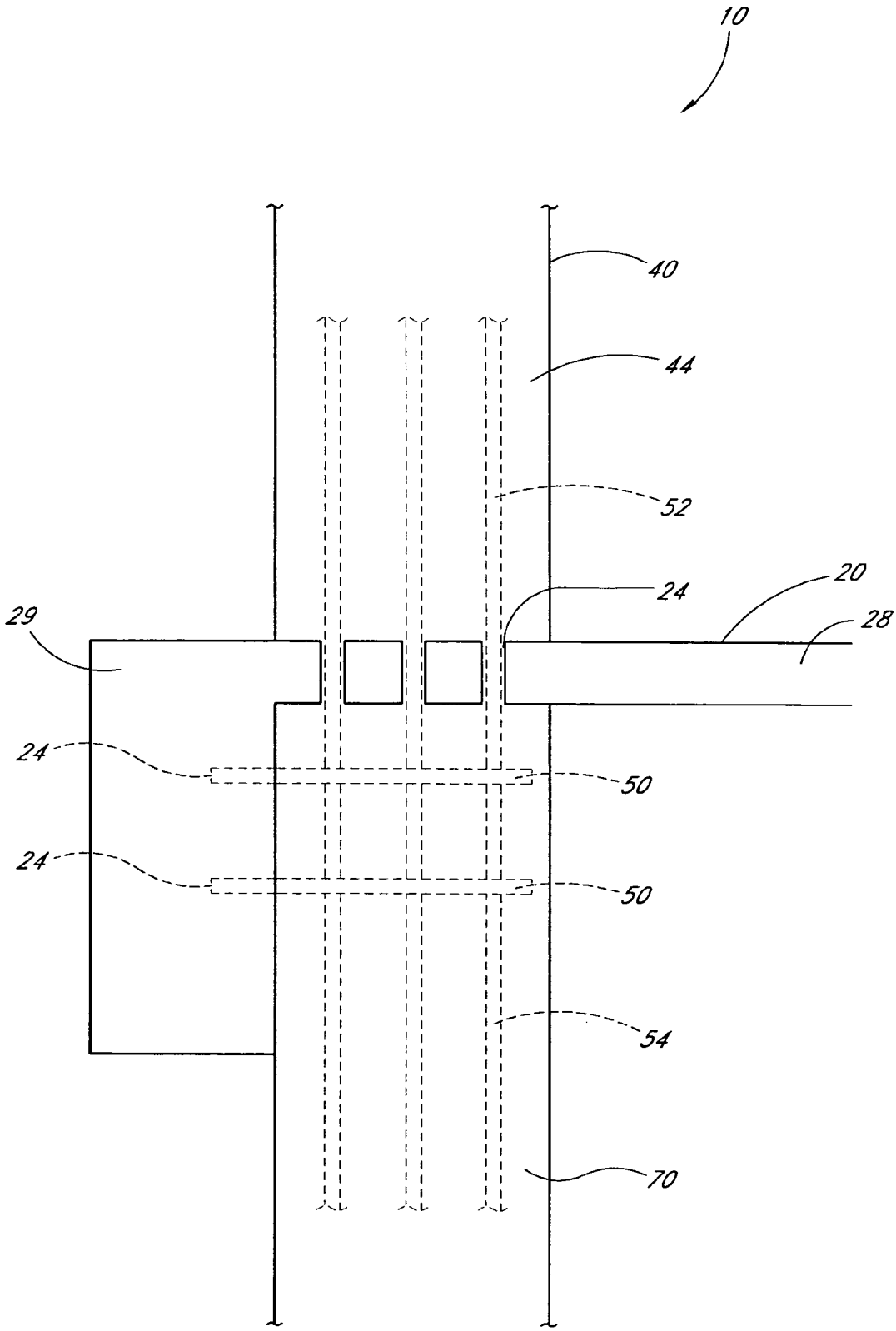
FIG. 7 schematically illustrates one embodiment of seismic retrofitting a portion of a concrete structure comprising a floor and a beam comprising holes bored through the floor and into the beam by irradiation by a laser beam.

As schematically illustrated in FIG. 7, in certain embodiments, the portion 20 of the concrete structure 10 comprises a floor 28 and beam 29 and removing material from the portion 20 comprises boring holes 24 into the floor 28 and the beam 29 by irradiating the portion 20 with the laser beam 30. These holes 24 are used in certain embodiments to couple a stabilization structure 40 comprising a stabilization column 44 to the floor 28 and beam 29. In such embodiments, the laser beam 30 is used to bore holes 24 through the floor 28 and into the beam 29. Rebars 50 are affixed to the beam 29 as described above and rebars 52 are inserted through the holes 24 of the floor 28 and coupled to the rebars 50 to form a rebar lattice structure 54.

In certain embodiments, coupling the stabilization structure 40 to the floor 28 and beam 29 further comprises forming a stabilization column 44 by pouring concrete 70 into a temporary mold built around the rebar lattice structure 54. Upon setting, the poured concrete 70 forms the stabilization column 44 which is contiguously coupled to both the floor 28 and beam 29, and which comprises the rebars 50, 52. In such an embodiment, the stabilization column 44 provides structural support to the concrete structure 10. Persons skilled in the art are able to form a stabilization column 44 in accordance with embodiments of the present invention.

Figure 8:
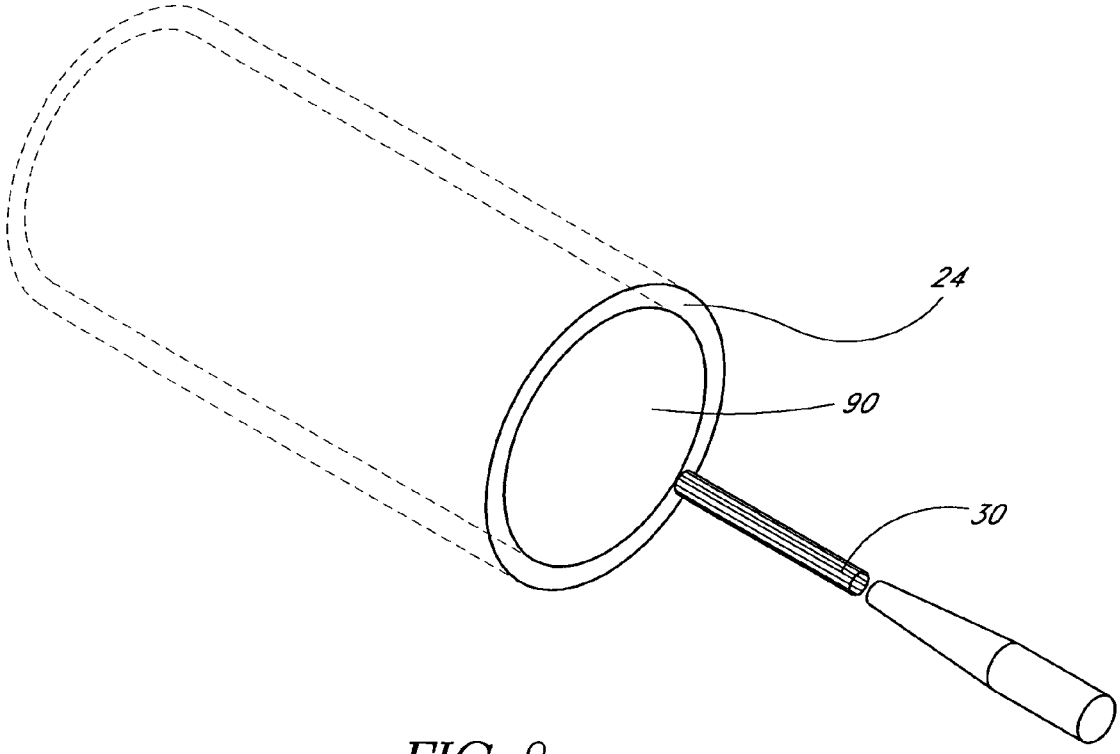
FIG. 8 schematically illustrates a hole cut into a portion of the concrete structure by coring a cylindrical plug using the laser beam.

In other embodiments, as schematically illustrated in FIG. 8, holes 24 can be cut into a portion 20 of the concrete structure 10 by coring a cylindrical plug 90 using the laser beam 30, and then breaking off the cylindrical plug 90. To core a cylindrical plug 90, the laser beam 30 is moved in a circular motion while directed at the surface of the portion 20 of the concrete structure 10, thereby cutting around the circumference of the hole 24. Such embodiments are particularly useful for forming large holes 24 while reducing the likelihood of heat damage to the concrete by avoiding the large power incident onto the concrete for removing all the material in the hole 24 by laser beam irradiation.

While illustrated in the context of retrofitting concrete structures, persons skilled in the art will readily find application for the methods and apparatus herein to other construction projects generally. Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A method of seismic retrofitting a concrete structure comprising:

scanning a laser beam across a surface of the concrete structure, the laser beam penetrating a depth into the concrete structure;

controlling the depth of penetration of the laser beam into the concrete structure;

removing material from the concrete structure;

forming at least one key in the surface of the concrete structure;

placing additional concrete around at least a portion of the concrete structure such that the additional concrete fills the at least one key; and using the at least one key to attach the additional concrete to the concrete structure.

2. The method of claim 1, wherein the at least one key is generally cylindrical.

3. The method of claim 1, wherein the at least one key is generally rectangular.

4. The method of claim 1, wherein placing the additional concrete around the at least a portion of the concrete structure comprises positioning a temporary mold in proximity to the concrete structure and pouring the new concrete into the temporary mold.

5. The method of claim 1, wherein the concrete structure comprises a wall.

6. The method of claim 5, wherein the at least one key is formed in a surface of the wall.

7. The method of claim 1, wherein controlling the depth comprises controlling a speed of the scanning of the laser beam across the surface.

8. The method of claim 1, wherein the concrete structure comprises a rebar member embedded in the concrete and removing material from the concrete structure comprises exposing a previously-embedded portion of the rebar member.

9. The method of claim 8, wherein the method further comprises coupling the additional concrete to the exposed portion of the rebar member.

10. The method of claim 8, wherein exposing the portion of the rebar member comprises detecting the rebar member and avoiding substantially irradiating the rebar member, thereby avoiding substantially damaging the rebar member.

11. The method of claim 10, wherein avoiding substantially irradiating the rebar member comprises passing the laser beam repeatedly across a portion of the surface of the concrete structure, cutting away a portion of concrete on each pass, until the rebar member is exposed and detected.

12. The method of claim 10, wherein avoiding substantially irradiating the rebar member comprises moving the laser beam away from the rebar member upon detecting light indicative of the rebar member.

13. The method of claim 10, where avoiding substantially irradiating the rebar member comprises reducing the laser energy density upon detecting light indicative of the rebar member.

14. The method of claim 10, wherein detecting the rebar member comprises deetecting light reflected from the rebar member as material is being removed from the concrete structure and responding to differences in interactions of the rebar member to incident light and interactions of the concrete to incident light.

15. The method of claim 14, wherein the differences are reflectance differences.

16. The method of claim 14, wherein the differences are photospectrometry differences.

* * * * *

UNITED STATES PATENT AND TRADEMARK OFFICE

CERTIFICATE OF CORRECTION

PATENT NO. : 7,491,950 B2
APPLICATION NO. : 11/653127
DATED : February 17, 2009
INVENTOR(S) : Kenneth Joe Breyer et al.

It is certified that error appears in the above-identified patent and that said Letters Patent is hereby corrected as shown below:

At column 10, line 36, in claim 13, please change “where” to --wherein--.

At column 10, line 41, in claim 14, please change “deetecting” to --detecting--.

Signed and Sealed this

Ninth Day of June, 2009

JOHN DOLL
*Acting Director of the United States Patent and Trademark Office*